US005113741A

United States Patent [19]

Nishikawa

[11] Patent Number: 5,113,741

[45] Date of Patent: May 19, 1992

[54] PERFORMANCE RECORDING APPARATUS FOR RECORDING INFORMATIONS USED TO CONTROL MUSIC GENERATION INSTRUMENTS

[75] Inventor: Hiroshi Nishikawa, Nagoya, Japan

[73] Assignee: Brother Kogyo Kabushiki Kaisha, Nagoya, Japan

[21] Appl. No.: 629,685

[22] Filed: Dec. 18, 1990

[30] Foreign Application Priority Data

Dec. 21, 1989 [JP] Japan ..... 1-331578

[51] Int. Cl.[5] ..... G10H 3/00

[52] U.S. Cl. ..... 84/609; 84/642; 84/DIG. 29

[58] Field of Search ..... 84/DIG. 29, 601, 609-614, 84/634-638, 626, 642, 649

[56] References Cited

U.S. PATENT DOCUMENTS 3,781,452 12/1973 Vauclain ..... 84/DIG. 29
4,788,896 12/1988 Uchiyama et al. ..... 84/609
4,899,632 2/1990 Okamura ..... 84/601
4,984,497 1/1991 Inagaki et al. ..... 84/626

*Primary Examiner*—William M. Shoop, Jr.
*Assistant Examiner*—Helen Kim
*Attorney, Agent, or Firm*—Oliff & Berridge

[57] ABSTRACT

The invention provides performance recording apparatus for separately recording plural event data, each corresponding to an electronic instrument, as plural channels of playing information onto playing information recorder. The apparatus includes channel converter for converting a channel discrimination code of newly received event data into another channel discrimination code, and merger for merging event data with the converted channel discrimination code with other event data which have already been recorded on the playing information recorder. Since any identical channel is not assigned to plural event data corresponding to different electronic instruments, playing information corresponding to plural channels is easily processed and stored on the playing information recorder.

19 Claims, 6 Drawing Sheets

PERFORMANCE RECORDING APPARATUS FOR RECORDING INFORMATIONS USED TO CONTROL MUSIC GENERATION INSTRUMENTS

BACKGROUND OF THE INVENTION

The present invention relates to a performance recording apparatus for recording information used for controlling electronic instruments to generate music.

Performance recording apparatuses utilizing playing information of an MIDI (musical instrument digital interface) have been proposed. The apparatus records playing information input from a keyboard of an electronic instrument or a computer in the form of digital event data showing operation of keys on the keyboard.

Playing information input signals or event data from a keyboard of an electronic instrument or a computer is first recorded on a recording track in a memory of the recording apparatus and then transferred to a merge track to be merged with playing information of other instruments. Each event data includes a channel discrimination code for discriminating it from data of other musical instruments. When event data corresponding to plural musical instruments are merged and stored on a merge track, data of a desired instrument are easily specified and selected with the channel discrimination code. A new channel is set by an operator corresponding to the channel discrimination code each time event data for plural electronic instruments are newly input. Namely, each channel is assigned by the operator to playing information for each of plural electronic instruments.

Each event data from an electronic instrument is thus recorded on a recording track by designating the channels. Plural recorded event data are then successively transferred from the recording track to a merge track to be merged thereon; the whole performance of music is thus completed.

The following problems, however, have arisen in the above process. When the receiving channel is not updated by the operator, a channel which has already been assigned to formerly stored event data is again assigned to receive event data newly sent from an electronic instrument. Switch-over between the channel setting mode and the recording mode is to be repeated many times when event data corresponding to a number of channels are merged with one another; it is rather troublesome. In a simple recording system without a display or certain switches, the current set channel is not shown when event data are newly input and recorded, and channels which have already been assigned to other event data are not specified easily.

SUMMARY OF THE INVENTION

The objective of the invention is to provide a performance recording apparatus in which plural channels of playing information are effectively processed and recorded to generate a performance of music without any trouble or difficulty.

The above and other related objectives are realized by a performance recording apparatus, shown in FIG. 1, for separately recording plural event data, each corresponding to an electronic instrument, as plural channels of playing information onto playing information recorder M1. The performance recording apparatus further includes channel converter M2 for converting a channel discrimination code in newly input event data into another channel discrimination code, and merger M3 for merging event data with the converted channel discrimination code with other event data which have already been recorded on the playing information recorder M1. The channel converter M2 converts a channel discrimination code in newly received event data input signals into a open and unused channel discrimination code, which is different from those assigned to event data stored on the playing information recorder M1.

The performance recording apparatus of the invention separately records plural event data, signals each corresponding to an electronic instrument. The channel converter M2 converts a channel discrimination code in newly input event data into another channel discrimination code. The merger M3 merges event data with the converted channel discrimination code with other event data stored on the playing information recorder M1. Since the channel converter M2 converts a channel discrimination code in newly input event data into an open and unused code which is different from those of event data stored on the playing information recorder M1, the same channel is not assigned to separate or different event data which may each correspond to different electronic instruments; i.e. any plural event data are not overlappingly recorded on the playing information recorder M1.

BRIEF DESCRIPTION OF THE DRAWINGS

The invention may be best understood by referring to the following detailed description of the preferred embodiment and the accompanying drawings, wherein like numerals denote like elements and in which.

DETAILED DESCRIPTION OF THE PREFERRED EMBODIMENT

Figure 1:
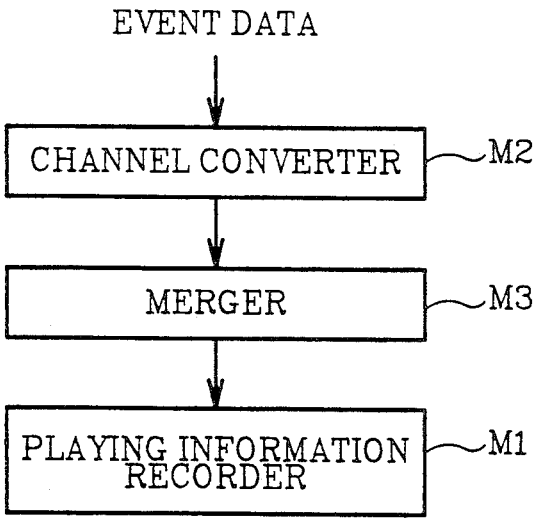
FIG. 1 is a block diagram showing features of the invention.

A preferred embodiment of the invention is now explained in detail referring to the drawings.

Since there may be many modifications without departing from the scope of the invention, the embodiment below is not intended to limit the invention to the embodiment but is intended to illustrate the invention more clearly.

Figure 2:
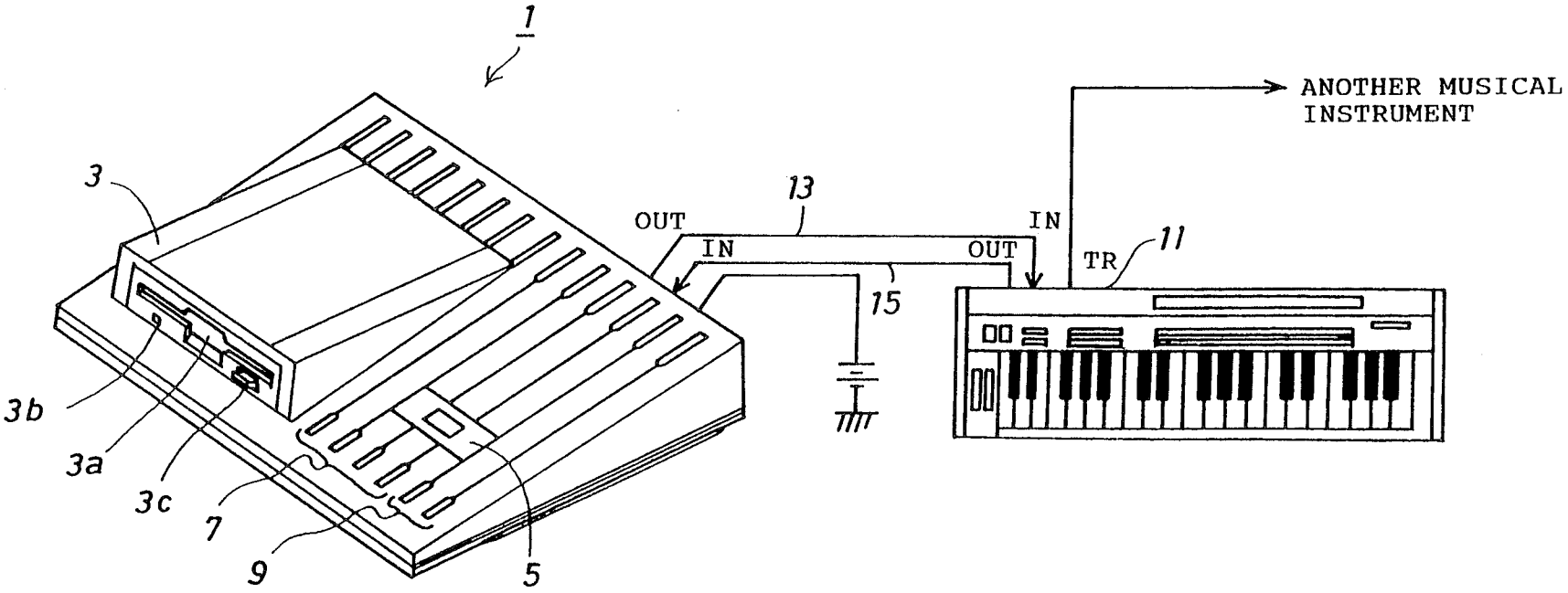
FIG. 2 is a schematic view illustrating a system including an MIDI sequencer and a keyboard, embodying the invention.

As shown in FIG. 2, a MIDI sequencer 1 includes a floppy disk unit 3, a liquid crystal display (hereinafter referred to as LCD) 5, function keys 7, and shift keys 9. The floppy disk unit 3 records and stores playing information, which includes event data and time data and is used for controlling electronic instruments to generate music, onto a recording medium or a floppy disk and then reproduces the information stored thereon. The floppy disk unit 3 has a slot 3*a* in which a floppy disk is inserted, an access lamp 3*b* for indicating that the unit is recording or reproducing, and an eject button 3*c* for ejecting the floppy disk.

The MIDI sequencer 1 is connected to a keyboard 11 through MIDI signal cables 13 and 15. The sequencer 1 receives event data from the keyboard 11 and stores the event data together with time data showing the time of the reception as playing information. The sequencer 1 outputs event data with such timing that time data stored with the event data instructs, and controls the keyboard 11 and another musical instrument to make them sound simultaneously.

The keyboard 11 receives event data sent from the MIDI sequencer 1 and distributes the event data to other musical instruments via a through terminal TR. Either of the MIDI signal cables 13 and 15 may be extended to be directly connected to other musical instruments. The MIDI sequencer 1 thus receives event data from plural musical instruments and records them together with corresponding time data as playing information; the MIDI sequencer 1 also outputs event data based on time data to plural musical instruments to make them sound.

Figure 3:
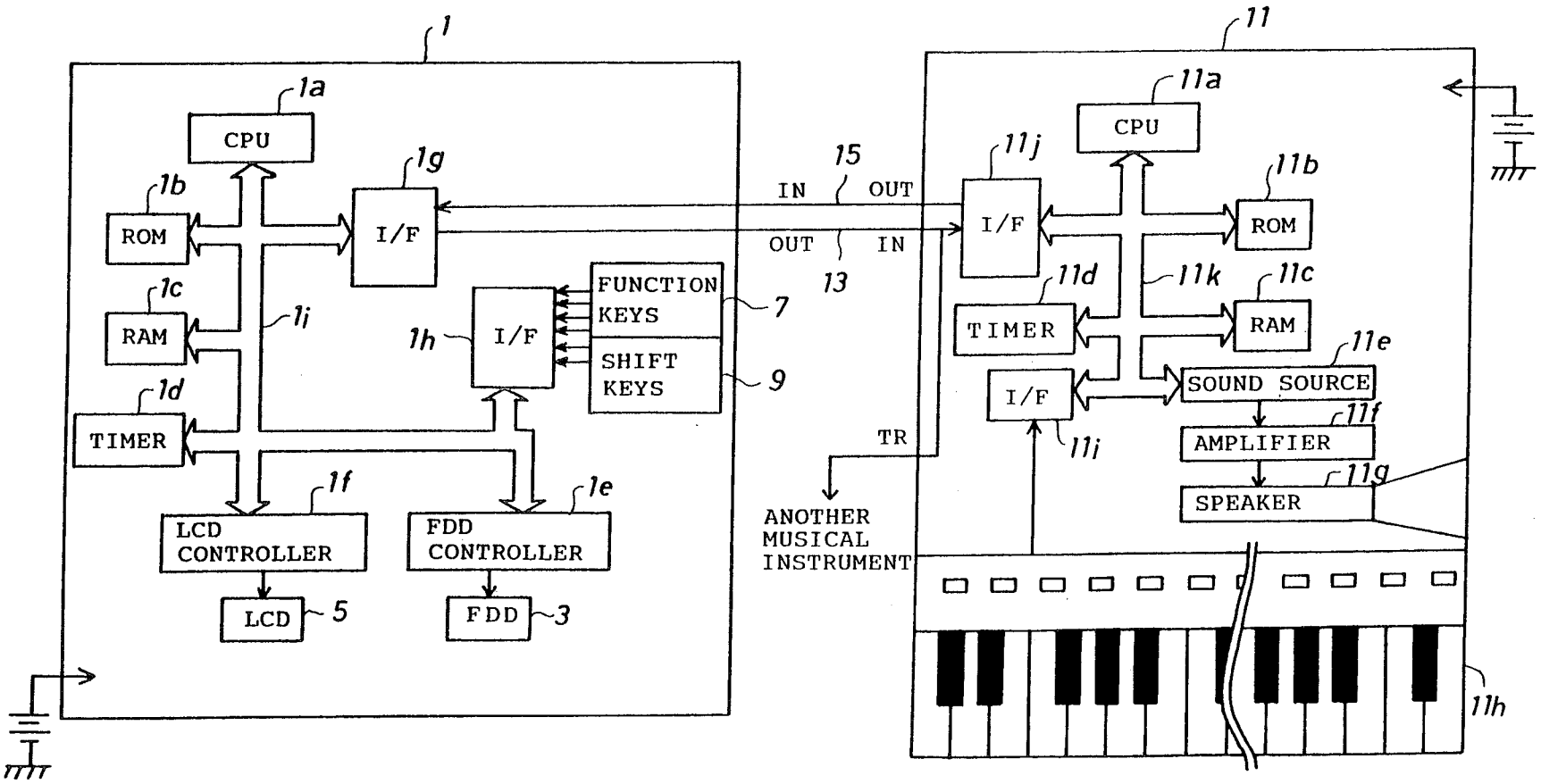
FIG. 3 is a block diagram showing the structure of the MIDI sequencer and the keyboard of FIG. 2.

FIG. 3 is a block diagram showing the signal processing system. The MIDI sequencer 1 has a central processing unit (hereinafter referred to as CPU) 1*a*, a read only memory (hereinafter referred to as ROM) 1*b*, a random access memory (hereinafter referred to as RAM) 1*c*, and a timer 1*d*, which comprises a digital computer. The MIDI sequencer 1 further includes a floppy disk controller 1*e* for driving and controlling the floppy disk unit 3, an LCD controller 1*f* for driving and controlling the LCD 5, an interface 1*g* for inputting and outputting event data in sequence, an input interface 1*h* for the keys 7 and 9, and a bus line 1*i* for connecting them to one another to transmit various signals.

The keyboard 11 also has a CPU 11*a*, a ROM 11*b*, a RAM 11*c*, and a timer 11*d*, which comprises a digital computer. The keyboard 11 further includes a sound source 11*e* for converting digital event data into an analog sound signal, an amplifier 11*f* for amplifying the analog sound signal, a speaker 11*g* for generating sound from the amplified sound signal, an interface 11*i* for keys 11*h*, an interface 11*j* for inputting and outputting event data in sequence, and a bus line 11*k* for connecting them to one another to transmit various signals.

Figure 4:
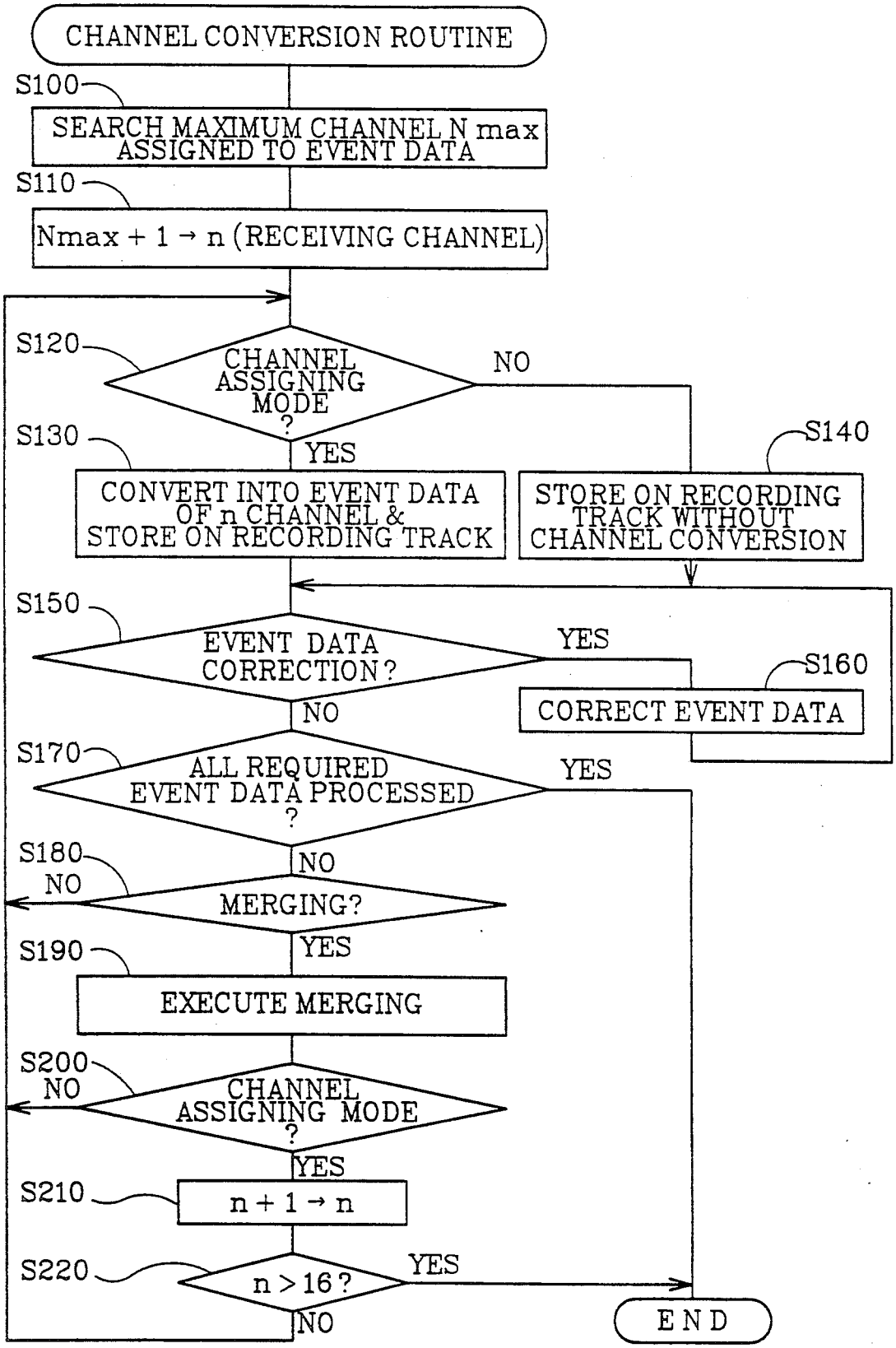
FIG. 4 is a flow chart showing a channel conversion routine executed by the MIDI sequencer.

The CPU 1*a* of the MIDI sequencer 1 executes various processes; steps for channel conversion are explained based on a flow chart of FIG. 4. This routine starts when recording of music is instructed or when recording of music is instructed again after interruption of recording. Although the keyboard 11 also executes various processes including normal performance, automatic performance based on input event data, and output of event data recorded through operation of the keys 11*h*, they are all well known and thus detailed explanation is omitted here.

When the routine starts, at step S100, the maximum channel Nmax assigned to event data stored on a merge track set in the RAM 1*c* is searched. At step S110, the maximum channel Nmax is incremented by one and Nmax+1 is assigned as the current receiving channel n. When no event data are recorded on the merge track, the value Nmax is set to zero. Therefore, when a piece of music is recorded for the first time, the current receiving channel n is equal to 1. When recording is started again after interruption, the receiving channel n is equal to the maximum channel Nmax plus one. The program then proceeds to step S120 at which it is determined if the channel assigning mode is selected. When the channel assigning mode is selected through operation of the function keys 7 and the shift keys 9, a channel discrimination code in event data newly received from the keyboard 11 is converted into a new code corresponding to the channel n and event data with the new channel discrimination code are recorded on a recording track set in the RAM 1*c* at step S130. Any channel discrimination code in event data received from the keyboard 11 is converted into a new channel discrimination code corresponding to the channel n.

On the other hand, when the channel assigning mode is not selected, at step S140, event data received from the keyboard 11 are stored on the recording track without channel conversion.

Figure 5:
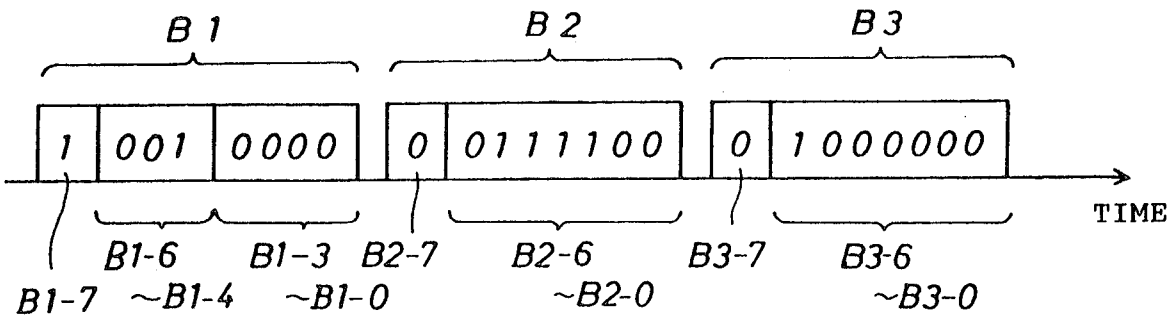
FIG. 5 is a view illustrating a configuration of event data.

Each unit of event data received from the keyboard 11 consists of, as shown in FIG. 5, three bytes: a first data byte B1, a second data byte B2, and a third data byte B3. When the first data byte B1 is identical, each unit may consist of only the second and the third data bytes B2 and B3. Though each byte includes a start bit and a stop bit, they are omitted in FIG. 5.

The seventh bit B1-7 of the first data byte B1 is '1'; the number establishes the identity of a status byte. Each seventh bit B2-7 of the second data byte B2 and the third data byte B3 is '0'; the number establishes the identity of a data byte.

In the status byte B1, the sixth through the fourth bits B1-6–B1-4 indicate various status words and the third through the null bits B1-3–B1-0 indicate various channels; that is, the lower four bits correspond to a channel discrimination code. Combination of digits on the status byte B1 gives eight different status words and sixteen different channels. In the sixth to fourth bits, '000' and '001' in binary notation respectively represent 'note off' (releasing or pressing off of the keys 11*h*) and 'note on' (pressing on of the keys 11*h*). Status words other than 'note on' and 'note off' include polyphonic key pressure, control change, and program change. In the lower four bits, '0000' through '1111' in binary notation respectively represent channels '1' through '16' in decimal notation.

For example, the status byte B1, '10010000', indicates that the status word is 'note on' and the channel is '1'. The data byte B2 indicates one of a hundred twenty eight different pitches and the data byte B3 indicates one of a hundred twenty eight different velocities (volumes).

Figure 6:
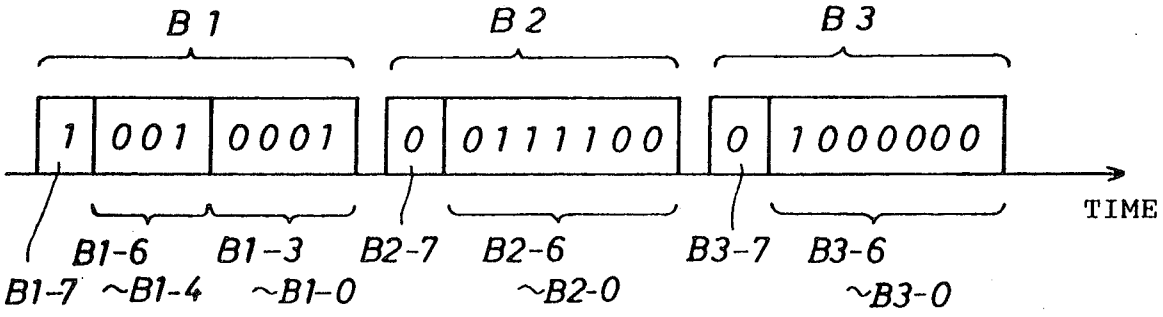
FIG. 6 is a view illustrating a configuration of event data after completion of channel conversion.

Process of step S130 means that the lower four bits of the status byte B1 are converted to a channel discrimination code corresponding to the channel n assigned at step S110. For example, when n is equal to 2 (channel 2), the third to the null bits B1-3 to B1-0 are converted into '0001' in binary notation as shown in FIG. 6. Event data with the converted channel discrimination code are recorded with corresponding time data onto a recording track at predetermined time intervals.

Figure 7:
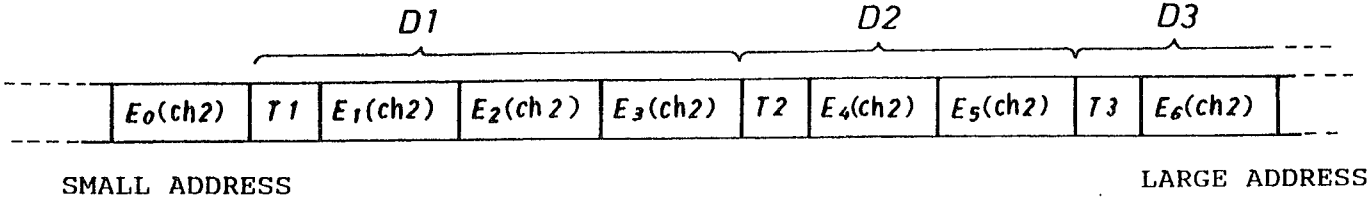
FIG. 7 is a view illustrating a configuration of playing information on a recording track.

FIG. 7 shows playing information recorded on the recording track. Event data E0 through E6 are stored with corresponding time data T1 through T3, which is marked at predetermined time intervals, as data blocks D1 through D3. Event data E1, E2, and E3 are input at a time point corresponding to the time data T1 and thus stored after the time data T1. Since the channel discrimination code of these event data is converted into '2' in decimal notation at step 130 of the channel conversion routine shown in FIG. 4. all data E0 through E6 are recorded as data of the channel '2' on the recording track.

In FIG. 4. the program proceeds to step S150 after completion of processing of step S130 or S140. At step S150, it is determined if correction or modification of event data stored on the recording track is required. When the answer at step S150 is YES, the program proceeds to step S160 at which event data are corrected or modified through operation of the function keys 7 and the shift keys 9 and then returns to step S150. When correction or modification is not required at step S150, the program proceeds to step S170 at which it is determined if all required playing information is processed. When the answer is YES at step S170, the program exits from the routine.

Figure 8A:
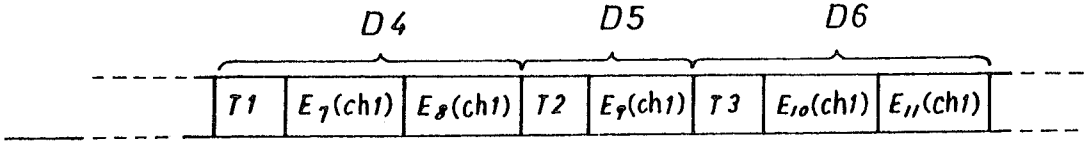
FIG. 8A is a view illustrating a configuration of another playing information recorded on the recording track.
Figure 8B:
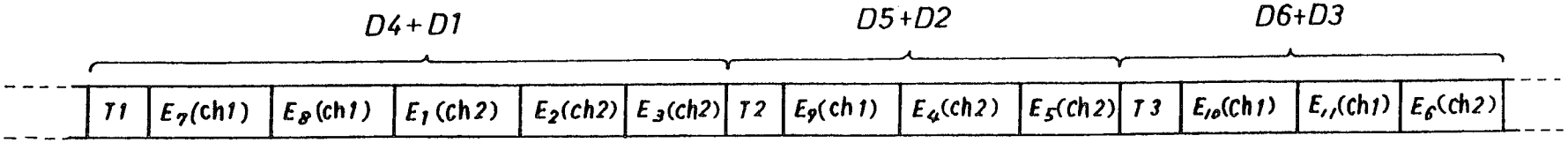
FIG. 8B is a view illustrating a configuration of playing information stored on a merge track.

When the answer is NO at step S170, the program proceeds to step S180 at which it is determined if merging is required. When merging process is selected, event data stored on the recording track are transferred to a merge track to be merged with event data of other channels stored on the merge track at step S190. For example, event data E1 through E6 of channel '2' (shown in FIG. 7) are merged with event data E7 through E11 of channel '1' (shown in FIG. 8A) on the merge track as shown in FIG. 8B.

Merged event data. i.e., event data of two different channels, are output through the MIDI signal cable 13 corresponding to time data so as to control two electronic instruments and generate sound simultaneously.

When the answer is NO at step S180, the program returns to step S120. After completion of merging process at step S190, the program proceeds to step S200 at which it is determined if the channel assigning mode is selected in a similar manner as step S120. When the channel assigning mode is selected. the program proceeds to step S210 at which the receiving channel n is incremented by one and is updated. When the channel assigning mode is not selected, the program returns to step S120.

At step S220, the updated receiving channel n is compared with 16, which is the number of available channels. 1 through 16. When the channel n is greater than 16, the program exits from the routine. On the other hand, when the channel n is smaller than 16, that is, when there are still some vacant channels, the program returns to step S120.

The MIDI sequencer 1 of the embodiment converts the receiving channel number for receiving event data from the keyboard 11 into an open channel which is different from those assigned to event data stored on the merge track. The receiving channel is incremented by one every time when merging process is executed. Channels 1 through 16 are thus successively assigned to event data newly received, which are stored in series on the merge track. No additional operation is required for updating of the receiving channel. Further, any identical channel is not assigned to plural event data corresponding to different electronic instruments; i.e., any plural event data are not overlappingly recorded. Troublesome switch-over of the mode is not required, thus reducing errors on operation.

In the MIDI sequencer of the embodiment, since the receiving channel is automatically updated, a display and certain switches may be omitted. Accordingly, playing information corresponding to plural channels is easily processed and recorded on the MIDI sequencer of the embodiment. Furthermore, a channel conversion process is executed only when a it is required. That is. when channel conversion process is not required. input event data are stored as they are.

Although the receiving channel is updated to a value Nmax+1 in the above embodiment. it may be updated in series from channel '1' or updated to any channel which had not been assigned to event data on the merge track. Though event data are input from the keyboard 11 in the above embodiment, they may be input from a computer, a digital woodwind or brass, or any other musical instruments.

As described above, the performance recording apparatus of the invention converts a channel discrimination code of newly received event data into an open and unused code which is different from those already assigned to event data on the playing information recorder and merges the event data with the converted channel discrimination code with other event data on the playing information recorder. Namely. updating of the receiving channel is automatically executed and troublesome switch-over of the mode is not required. thus reducing errors on operation. Since any identical channel is not assigned to plural event data corresponding to different electronic instruments, playing information corresponding to plural channels is easily processed and stored on the playing information recorder of the performance recording apparatus of the invention.

What is claimed is:

1. Performance recording apparatus for recording plural event data including a channel discrimination code for discriminating one type of data from other types of data as separate plural channels of playing information onto a playing information recording means, comprising:

channel conversion means for converting a received channel discrimination code in newly received event data to an alternate channel discrimination code;

merging means for merging event data corresponding to said alternate channel discrimination code with other event data which have already been recorded on the playing information recording means; and channel assignment mode detection means for detecting channel assignment mode and enabling said channel conversion means upon detection of selection of a channel assignment mode, wherein said channel conversion means converts the received channel discrimination code in newly received event data into an alternate channel discrimination code corresponding to an unused channel discrimination code, which is different from any discrimination code assigned to event data stored on the playing information recording means and said channel conversion means provides as an output said received channel discrimination code when said channel assignment mode is not detected.

2. The performance recording apparatus of claim 1, wherein said channel discrimination code includes a binary representation of a channel number, and said channel conversion means includes means for changing said binary representation of a used channel to a binary representation of a channel number corresponding to an alternate channel.

3. The performance recording apparatus of claim 2, wherein said event data comprises MIDI data.

4. The performance recording apparatus of claim 2, further including means for selectively enabling said channel conversion means for converting received channel discrimination codes after a first channel discrimination code.

5. The performance recording apparatus of claim 2, wherein said channel conversion means includes means for incrementing said binary representation of a channel number.

6. The performance recording apparatus of claim 5, wherein each said channel number corresponds to a musical instrument.

7. The performance recording apparatus of claim 5, wherein said means for incrementing provides an incremented channel number after an interruption in recording.

8. The performance recording apparatus of claim 1, further including means for selectively enabling said merging means when a channel discrimination code after a first channel discrimination code is received.

9. The performance recording apparatus of claim 1, including a CPU for providing said channel conversion means and said merging means.

10. A method for recording plural event data, including a channel discrimination code for discriminating one type of data from other types of data, onto a playing information recording means having separate channels, comprising the steps of:

determining a channel discrimination code previously recorded on said playing information recording means;

receiving a channel discrimination code from a musical instrument;

changing said received channel discrimination code to a channel discrimination code not previously recorded on said playing information recording means;

merging at least two event data with the plural event data into merged data;

storing said merged data in said playing information recording means; and transferring said stored merged data to at least one musical instrument.

11. The method of claim 10, wherein the step of changing the received channel discrimination code comprises incrementing the received channel discrimination code.

12. The method of claim 11, wherein the step of incrementing the received channel discrimination code comprises the step of incrementing a MIDI channel number.

13. The method of claim 12, further including the steps of:

determining a maximum available channel discrimination code; and ceasing execution of said steps when said incremented channel discrimination code exceeds said maximum channel discrimination code.

14. The method of claim 10, wherein the step of determining a channel discrimination code previously recorded comprises the step of searching for a maximum channel number previously assigned to event data stored on a merge track in said playing information recording means.

15. The method of claim 10, further including the steps of:

detecting defective event data; and correcting said defective event data.

16. The method of claim 10, further including the steps of:

detecting a channel assignment mode; and enabling the step of changing said received channel discrimination code when the channel assignment mode is detected.

17. Performance recording apparatus for recording plural event data including a channel discrimination code for discriminating one type of data from other types of data as separate plural channels of playing information onto a playing information recording means, comprising:

channel conversion means for converting a received channel discrimination code in newly received event data to an alternate channel distribution code;

merging means for merging event data corresponding to the alternate channel discrimination code with other event data which have already been recorded on the playing information recording means; and search means for searching said playing information recording means to determine an alternate channel discrimination code corresponding to an unused channel discrimination code, the unused channel discrimination code being different from any discrimination code assigned to event data stored on said playing information recording means.

18. The performance recording apparatus of claim 17, wherein said search means includes means for searching a maximum channel number previously assigned to event data stored on a merge track in said playing information recording means.

19. The performance recording apparatus of claim 18, wherein said search means includes means for determining the unused channel discrimination code corresponding to a channel number which is more than the maximum channel number.

* * * * *